US010575555B2

(12) United States Patent
Fallon et al.

(10) Patent No.: US 10,575,555 B2
(45) Date of Patent: Mar. 3, 2020

(54) SMOKING ARTICLE

(71) Applicant: British American Tobacco (Investments) Limited, London (GB)

(72) Inventors: Gary Fallon, London (GB); Karl Kaljura, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 372 days.

(21) Appl. No.: 15/287,680

(22) Filed: Oct. 6, 2016

(65) Prior Publication Data

US 2017/0020185 A1 Jan. 26, 2017

Related U.S. Application Data

(62) Division of application No. 14/429,671, filed as application No. PCT/GB2013/052511 on Sep. 26, 2013, now Pat. No. 9,480,284.

(30) Foreign Application Priority Data

Oct. 5, 2012 (GB) ..... 1217894.3

(51) Int. Cl.
*A24D 3/04* (2006.01)

(52) U.S. Cl.
CPC ..... *A24D 3/041* (2013.01); *A24D 3/043* (2013.01)

(58) Field of Classification Search
None
See application file for complete search history.

(56) References Cited

U.S. PATENT DOCUMENTS 3,308,832 A * 3/1967 Stelzer ..... A24C 5/475 131/94
4,527,573 A 7/1985 Hausermann
4,570,649 A 2/1986 Nichols et al.
4,699,158 A * 10/1987 Sprinkel, Jr. ..... A24D 3/041 131/198.2
4,700,725 A 10/1987 Geiszler
(Continued)

FOREIGN PATENT DOCUMENTS

EP 2033531 A1 3/2009
WO 2011051115 A1 5/2011
WO 2011121328 A2 10/2011

OTHER PUBLICATIONS

International Report on Patentability dated Apr. 7, 2015 re: Application No. PCT/GB2013/052511; pp. 1-4.
(Continued)

*Primary Examiner* — Phu H Nguyen
(74) *Attorney, Agent, or Firm* — Cantor Colburn LLP

(57) ABSTRACT

A smoking article comprising a first part moveable relative to a second part, and an indexing mechanism comprising a first indexing surface on the first part, and a second indexing surface on a support element of the second part. The second indexing surface is configured to engage with the first indexing surface to control relative movement between the first part and second part. One or more spacer elements are arranged to control a radial position of the first indexing surface relative to the second indexing surface. The support element and one or more spacer elements are frangibly connected.

12 Claims, 6 Drawing Sheets

(56) References Cited

U.S. PATENT DOCUMENTS

| | | | |
|---|---|---|---|
| 5,058,608 | A | 10/1991 | Henning et al. |
| 2011/0232663 | A1 | 9/2011 | Kadiric et al. |

OTHER PUBLICATIONS

International Search Report dated Mar. 21, 2014 re: Application No. PCT/GB2013/052511; pp. 1-3; citing: WO 2011/121328 A2, US 5 058 608 A, US 4 570 649 A and EP 2 033 531 A.
Written Opinion dated Mar. 21, 2014 re: Application No. PCT/GB2013/052511; pp. 1-3; citing: WO 2011/121328 A2.

* cited by examiner

SMOKING ARTICLE

CLAIM FOR PRIORITY

This application is a Divisional of and claims priority under 35 U.S.C. § 120 to U.S. patent application Ser. No. 14/429,671, filed Mar. 19, 2015 and entitled "Smoking Article," which in turn is a National Stage Entry entitled to and hereby claims priority under 35 U.S.C. §§ 365 and 371 to corresponding PCT Application No. PCT/GB2013/052511, filed Sep. 26, 2013, which in turn claims priority to British Patent Application Serial No. GB 1217894.3, filed Oct. 5, 2012. The entire contents of the aforementioned applications are herein expressly incorporated by reference.

TECHNICAL FIELD

Embodiments of the invention relate to a smoking article, a blank for forming a smoking article, a component of a smoking article and a method of manufacturing a smoking article.

BACKGROUND

U.S. Pat. No. 4,699,158 describes a smoking article in which a ventilation can be controlled by rotation of a part of the smoking article.

SUMMARY

An embodiment of the invention provides, in a first aspect, a smoking article comprising: a first part moveable relative to a second part, and an indexing mechanism comprising a first indexing surface on the first part, and a second indexing surface on a support element of the second part, wherein the second indexing surface is configured to engage with the first indexing surface to control relative movement between the first part and second part, and further comprising: one or more spacer elements arranged to control a radial position of the first indexing surface relative to the second indexing surface, wherein the support element and one or more spacer elements are initially frangibly connected.

An embodiment of the invention provides, in a second aspect, a blank for wrapping around one or more rod articles for one or more smoking articles, the blank comprising: a second indexing surface on a support element, wherein the second indexing surface is configured to engage with a first indexing surface on the or each of the rod articles to control relative movement between the first and second indexing surfaces, and further comprising: one or more spacer elements arranged to control a radial position of the first indexing surface relative to the second indexing surface, wherein the support element and one or more spacer elements are frangibly connected.

An embodiment of the invention provides, in a third aspect, a component of a smoking article comprising: a filter section forming a first part of the component, a support element forming a second part of the component, an indexing mechanism comprising a first indexing surface on the filter section of the first part, and a second indexing surface on a support element of the second part, wherein the second indexing surface is configured to engage with the first indexing surface to control relative movement between the first part and second part, and further comprising: one or more spacer elements arranged to control a radial position of the first indexing surface relative to the second indexing surface, wherein the support element and one or more spacer elements are frangibly connected.

An embodiment of the invention provides, in a fourth aspect, a method of manufacturing a smoking article comprising: forming an indexing mechanism by attaching a first part comprising a first indexing surface to a second part comprising a support element having a second indexing surface, wherein the second indexing surface is configured to engage with the first indexing surface to control relative movement between the first part and second part, the method comprising: attaching one or more spacer elements arranged to control a radial position of the first indexing surface relative to the second indexing surface, wherein the support element and one or more spacer elements are initially frangibly connected.

An embodiment of the invention provides, in a fifth aspect, a smoking article comprising: a first part moveable relative to a second part, and an indexing mechanism comprising a first indexing surface on the first part, and a second indexing surface on a second part, wherein the second indexing surface is configured to engage with the first indexing surface to control relative movement between the first part and second part, and further comprising: one or more spacer elements arranged to control a radial position of the first indexing surface relative to the second indexing surface, wherein second indexing surface is supported by a sleeve extending around the first indexing surface and one or more spacer elements, wherein the sleeve is configured to contact the one or more spacer elements to control a radial position of the first indexing surface relative to the second indexing surface.

BRIEF DESCRIPTION OF THE DRAWINGS

Various embodiments of the invention(s) will now be disclosed, by way of non-limiting example only, with reference to the accompanying drawings, in which.

DETAILED DESCRIPTION

For purposes of illustration, and not limitation, FIGS. 1 to 7 show examples of smoking articles or components of smoking article(s) according to embodiments of the invention(s). The smoking article is an article such as a cigarette, cigar or cigarillo, whether based on tobacco, tobacco derivatives, expanded tobacco, reconstituted tobacco or tobacco substitutes and also heat-not-burn products (i.e. products in which flavour is generated from a smoking material by the application of heat without causing combustion of the material). For convenience, these will be referred to as "smoking articles" in this specification.

Figure 1:
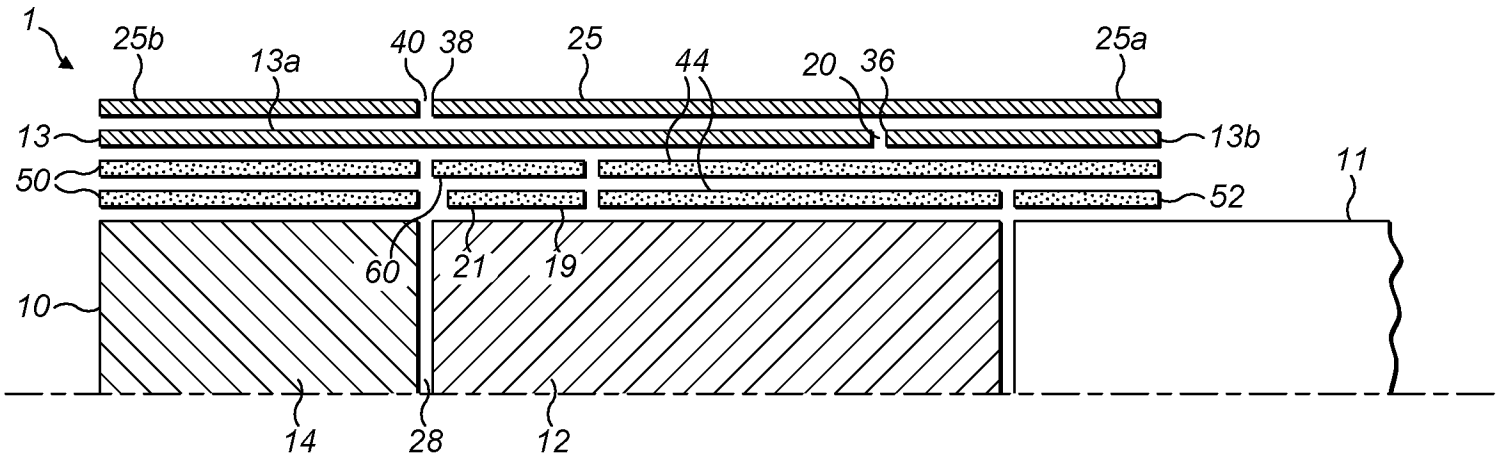
FIG. 1 is a longitudinal cross-section through a part of a smoking article according to a first embodiment of the invention.
Figure 2:
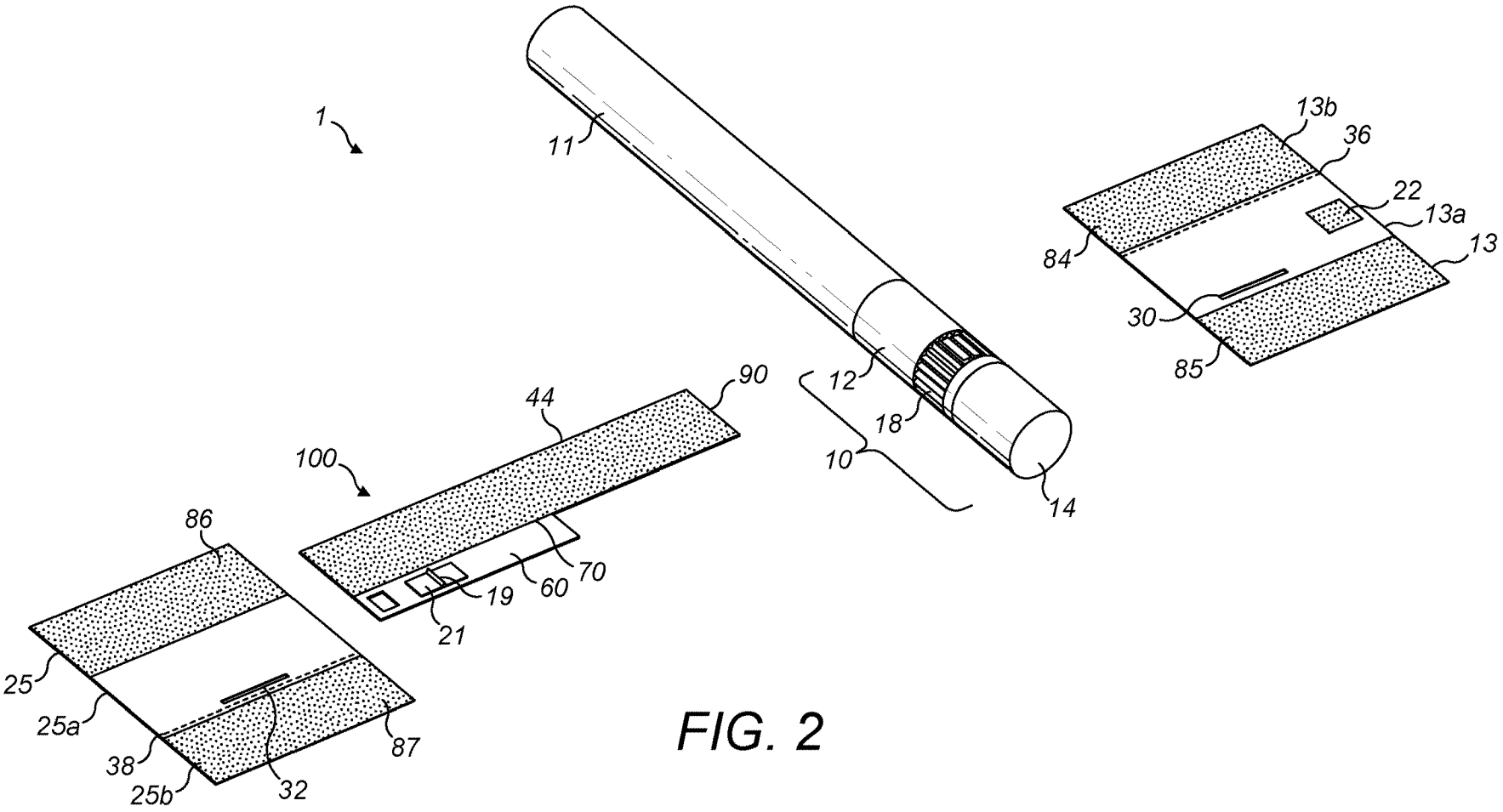
FIG. 2 is an exploded perspective view of an exemplary smoking article according to the first embodiment of the invention.

As shown in FIGS. 1 and 2, the smoking article 1 includes a first part comprising a source of smokable material 11, which is preferably tobacco. As illustrated, the source of smokable material 11 is in the form of a tobacco rod. The smoking article 1 further comprises a filter assembly 10 attached to the source of smokable material 11. The exemplary smoking article comprises a movable part, movable to select a ventilation level. In this example, the movement is a rotation. In some implementations, the smoking article optionally comprises a limiter (limiting mechanism), configured to limit movement to a pre-determined range.

The filter assembly 10 comprises a first filter section 12 and a second filter section 14. The first filter section 12 is attached to the source of smokable material to form a single unit. The tobacco rod and first filter section 12 are connected with a covering layer to affix the first filter section 12 to the tobacco rod, for example formed of sheet material, e.g. tipping paper, as is known. The tobacco rod and first filter section are referred to as a first part of the smoking article, or as a tobacco unit. The elongate tobacco rod and first filter section define a longitudinal axis of the smoking article. A rearward direction is defined towards a mouth end of the smoking article, and a forward direction is defined towards a tobacco, or lighting, end of the smoking article.

A second part of the smoking article comprises the second filter section 14. The second filter section 14 is co-axial with the first filter section 12, and is located rearwardly of the first filter section 12.

The first and/or second filter sections 12, 14 are made of a conventional filtration material, e.g. cellulose acetate tow. The filtration material is wrapped in a sheet material, for example paper, e.g. plugwrap.

The second part of the smoking article further comprises a sleeve 13 in the form of a cylindrical tube extending around the circumference of the tobacco rod 11 and/or first filter section 12. The material of the sleeve 13 is substantially impermeable to air, and is formed as a cylinder of sheet material, e.g. paper. The tobacco rod and first filter section are dimensioned to rotate as a unit around a longitudinal axis within the sleeve 13. The second filter section 14 is at a mouth end of the sleeve 13, adjacent to the first filter section 12. The second filter section 14 is securely attached and fixed within the sleeve.

The first part has a first interface 20 with the second part. The interface 20 is located around the first part, i.e. the interface 20 is aligned with the first part. In particular, the interface 20 is defined between a forward end of the sleeve 13 and an adjacent layer of the first part, relative to which the sleeve 13 is movable. The interface 20 can be located around the first filter section 12 or tobacco rod 11. The interface is the external area at which the first and second parts meet, as viewed from outside of the sleeve 13. The first interface 20 is a circumferentially extending gap between the sleeve 13 and the first part. Thus, the interface 20 is defined as an external interface between the first part and the sleeve 13 (second part).

An internal interface 28 between the first and second parts is defined as the adjacent areas of the first and second filter sections 12, 14. The internal interface 28 is spaced longitudinally from the first interface 20. The internal interface 28 is located rearwardly of the first interface 20.

The smoking article 1 further comprises a cover 25. The cover 25 is in the form of a cylindrical tube or sleeve, for example, formed of a sheet material such as paper. The cover 25 can, in some embodiments, be formed of a material which is substantially impermeable to air. The cover 25 extends over the first interface 20, substantially preventing air from entering the smoking article directly at the first interface 20. The cover 25 is located on an exterior of the first and second parts, and is in close radial proximity to the first and second parts. In particular, the cover 25 extends longitudinally forwardly and rearwardly of the first interface 20, and extends around the whole circumference of the first interface 20. The cover 25 is attached to the first part of the smoking article. The cover 25 is rotatable as a unit with the first part, and rotatable relative to the second part.

In some embodiments, the material forming the sleeve 13 comprises a frangible connection or separation line 36, which extends substantially circumferentially. The material of the sleeve is configured to easily break along the separation line 36 into a rearward part 13*a* and a forward part 13*b*. The rearward part 13*a* is affixed to the second filter section 14, and is a component of the second part of the smoking article which is rotatable around the first part as described for the sleeve 13 above. The forward part 13*b* is connected to the first filter section 12. The forward part 13*b* is considered as a component of the first part of the smoking article. Optionally, the forward part 13*b* of the sleeve 13 connects the tobacco rod 11 and first filter section 12. The separation line 36 is defined by a plurality of perforations through the sheet material (e.g. paper) of the sleeve 13.

As shown in FIGS. 1 and 2, the position of the second part relative to the first part is controlled by an indexer (indexing mechanism), configured to provide indexed rotation between a plurality of discrete positions. The indexing mechanism optionally provides a sound indicating movement to or from the selected position, i.e. an audible sound. The indexing mechanism comprises a first indexing section (or surface) 18 on the tobacco unit, for example, on the first filter section 12. The first indexing section is engaged with a second indexing section (or surface) 19 attached to the sleeve 13. The indexing mechanism provides a number of indexed positions, such as at least three, preferably at least five or seven within a limited range of rotation, e.g. 90 or 120 degrees.

In an exemplary indexing mechanism, the first indexing section 18 has a plurality of depressions which are engageable by a protruding feature on the second indexing section. The depressions can form a corrugated exterior surface, comprising a plurality of elongate grooves, separated by ridges, which extend substantially longitudinally.

The second indexing section 19 comprise one or more protrusions which are engageable with the first indexing section 18. The protrusion(s) comprise one or more pawls 19. In some examples, the pawl is formed by one or more layers of sheet material which are folded to extend radially inwardly from the sleeve 13. The term "pawl" is intended to mean any type of protrusion which can engage with an indexing section to allow indexed movement in two directions. The upstanding pawl is formed on a substrate 21, which is a sheet material, for example, paper. The substrate 21 is affixed to an interior surface of a pawl support unit 60, also termed a support element 60, for example, by adhesive. The substrate is folded to define the pawl as an upstanding ridge of sheet material, forming an edged peak. The pawl 19 has a substantially triangular cross-section. The indexing mechanism is separate and distinct from a limiting mechanism configured to limit the range of rotation between the first and second parts. The substrate 21 extends over a part only of the circumference of the rod articles.

The pawl support unit 60 is configured to be attached to an interior of the overlying sleeve 13. The pawl support unit 60 is attached by adhesive over an area 22 of the sleeve 13.

In some embodiments, the smoking article comprises a spacer 44 adjacent to the pawl 19. The spacer is alternatively termed a spacer element. The spacer 44 is configured to radially space an exterior surface of the tobacco unit from the surrounding pawl support unit 60. In particular, the spacer 44 provides radial space for the substrate (support element) 21 and/or to provide radial space for the pawl (second indexing surface) 19 to disengage from a groove of the first indexing surface 18 to move between indexing positions. The sleeve 13, to which the pawl support unit 60 is attached, overlies and surrounds the spacer 44. Thus, the spacer 44 contacts the sleeve 13, and maintains the spacing between the pawl support unit 60 and rod articles 10. Therefore, a relative radial positioning between the first and second indexing sections 18, 19 is determined or controlled. In particular, the one or more spacer sets a minimum radial position between first and second indexing surfaces. The one or more spacer can be considered as setting a minimum radial separation between a radially protruding pawl of the second indexing surface and a radially furthest point on the first indexing surface, e.g. the bottom of a groove.

The spacer 44 is in the form of one or more layers of sheet material, e.g. paper, in particular, tipping paper. For example, the spacer comprises a layer of sheet material extending around the circumference of the tobacco unit, forwardly and/or rearwardly of the first indexing section 18. A layer of sheet material forming the spacer 44 can optionally connect the first filter section 12 to the tobacco rod 11. The spacer 44 is affixed to the first filter section 12, for example with adhesive. The spacer 44 extends at least once around the whole circumference of the rod article.

The rearward part 13*a* is affixed to the second filter 14, optionally through one or more spacing layers 50. The forward part 13*b* is affixed to the first filter 12 and/or tobacco rod 11, optionally through the spacer 44 and/or one or more spacing layers 52. The spacer 44 and spacing layers 50, 52 (if present) provide a uniform surface on which the sleeve can be subsequently wrapped. The rearward and forward parts 13*a*,13*b* of the sleeve 13 provide a uniform surface on which the cover 25 is wrapped.

In some embodiments, the material forming the cover 25 can include a frangible connection or separation line 38, which extends substantially circumferentially. The material of the cover is configured to easily break along the separation line 38 into a forward part 25*a* and a rearward part 25*b*. The forward part 25*a* is affixed to the first part of the smoking article, and is a component of the first part of the smoking article which is rotatable around the second part as described for the cover 25 above. The rearward part 25*b* is affixed to the second part of the smoking article, in particular, to an exterior of the sleeve 13 (rearward part 13*a* of the sleeve). The rearward part 25*b* is considered as a component of the second part of the smoking article. The separation line 38 is defined by a plurality of perforations through the sheet material (e.g. paper) of the cover 25.

The rearward part 25*b* of the cover is affixed to the sleeve 13, in particular to the rearward part 13*a* of the sleeve 13. The forward part 25*a* of the cover 25 is affixed to the forward part 13*b* of the sleeve 13.

FIG. 2 shows components forming the smoking article shown in FIG. 1. The smoking article can comprise a ventilation system configured to allow adjustment of a ventilation of the smoking article. The ventilation system can include one or more ventilation areas, which in turn include ventilation apertures and/or air permeable material, in one or each of the first part and second part. For example, when ventilation areas in the sleeve, cover and/or layers of sheet material around the first and/or second filter sections are aligned or overlap, air can flow into the body of the first and/or second filter section. The ventilation is selected by selecting a position of the second part relative to the first part to determine an amount of overlap of the ventilation areas.

The cover 25 comprises one or more first ventilation areas 32. In some embodiments, the first ventilation area 32 is one or more apertures in the cover, for example, in the form of a narrow circumferential slit. The first ventilation area is elongate, in this example, in a circumferential direction. The first ventilation area extends circumferentially over a part only of the circumference. The first ventilation area extends at a single longitudinal position. The first ventilation area 32 allows ingress of air into the cover, for example, at or around the first filter section.

The sleeve 13 is provided with one or more second ventilation areas 30. The sleeve 13 comprises one or more apertures in the sleeve, for example, a narrow circumferential slit or a plurality of discrete ventilation areas in a circumferentially extending area. The second ventilation aperture 30 is at a single longitudinal position. The second ventilation area is elongate, in this example, in a circumferential direction. The first and second ventilation areas can be rearward, forward or coincident with the one or more spacers 44 or pawl support unit 60.

The tobacco unit 11, 12 optionally comprises one or more third ventilation areas (not shown). In some embodiments, the third ventilation area is in the form of a plurality of discrete ventilation areas in a circumferentially extending area. The third ventilation area has the same configuration as the first ventilation area and/is aligned with the first ventilation area. The third ventilation aperture allows ingress of air into the tobacco unit, for example, into the first filter section 12 and/or second filter section 14. The third ventilation area is one or more apertures or air permeable areas allowing air into the filtration material, through the layers of generally impermeable sheet material surrounding the filtration material. For example, the third ventilation area may extend through any spacing layer or pawl support unit, to allow air into the rod articles. An overlap of the first, second and third ventilation areas allows ventilating air into the body of the smoking article, through the variable area of overlap. The first and third ventilation areas are radially spaced and are fixed relative to each other. The second ventilation area 30, allowing air through the cover, is movable between the first and third ventilation areas to control the ventilation level of the smoking article. Alternatively, material underlying the sleeve is permeable to air, allowing air into the rod articles without a further ventilation aperture.

In some embodiments, the sleeve 13 and/or cover 25 comprises one or more further ventilation areas (not shown). The further ventilation area can provide ventilation which is independent of the rotational position of the position of the first and second parts of the smoking article. The further ventilation area provides a base level, or minimum, ventilation to the smoking article. In some examples, the further ventilation area allows air through the sleeve, and into the second filter section 14. The second filter section 14 comprises filtration material surrounded by a porous paper wrap (e.g. plugwrap), which allows the ventilating air into the filtration material of the second filter section 14. The further ventilation area can comprise a plurality of apertures extending circumferentially in a line.

The sleeve 13 is provided with adhesive over areas 84, 85 for affixing the sleeve 13 (directly or indirectly) to one or more of the rod articles, i.e. tobacco rod, or first and/or second filter sections. The sleeve 13 extends directly around the pawl support unit 60 and spacer 44. The cover is provided with adhesive over areas 86, 87 for affixing the cover to an exterior of the sleeve 13.

FIGS. 1 and 2 show the smoking article comprises a single spacer 44 which is initially frangibly connected to the pawl support unit by a frangible connection 70. The spacer 44 is located longitudinally of the pawl 19. In the example shown, the spacer 44 is located forwardly of the pawl 19 and pawl support unit 60. Alternatively, the spacer 44 is located rearwardly of the pawl and pawl support unit 60.

In some examples, the smoking article comprises a further spacer (not shown), which is applied separately. For example, the further spacer is sheet material wrapped the same number of times around the second filter section as the spacer 44 is wrapped around the first filter section. The further spacer also provides support to maintain a separation of the pawl support unit from the rod articles. In a further example of the invention (shown in FIG. 6), a pawl support unit is frangibly connected to two spacer elements 44, one forward and one rearward of the pawl support unit.

In some examples, a rearward edge of the pawl support unit 60 is substantially aligned with a rearward end of the first filter section 12. In particular, a rearward edge of the pawl 19 is substantially aligned with a rearward edge of the first filter section 12. The first indexing surface extends to or adjacent a rearward end of the first filter section 12, and is aligned with the pawl 19 forming the second indexing surface.

The spacer 44 can assist in ensuring the smoking article has a circular cross-section. The pawl 19 extends radially outwardly from the exterior surface of the first indexing section, so that rolling the sleeve 13 around the shape of only the first indexing section 18 and pawl 19 could give a non-circular shape. The spacer 44 extends radially outwardly from the exterior of the first indexing section by the same or greater distance than the extent of the pawl 19 radially outwardly from the exterior of the first indexing section. The spacer 44 provides a circular outer cross-section, around which the cover 13 can be rolled.

In some examples, the one or more spacer 44 is initially integrally formed with the pawl support unit 60. The spacer 44 and pawl support unit 60 are connected when wrapped around the rod articles. The spacer 44 is dimensioned to be wrapped two times around the whole circumference of the rod articles, and in particular, twice around the first filter section 12. The spacer 44 comprises a two layer tube (e.g. cylinder) around the rod articles. The pawl support unit 60 is dimensioned to be wrapped once around the first filter section 12. The pawl support unit 60 forms a one layer tube (e.g. cylinder around the rod articles. The one-layer tube of the pawl support unit 60 is radially aligned with the outer tube of the two layer tube of the spacer 44. The pawl 19 and substrate 21 are aligned with the inner tube of the two layer tube of the spacer 44.

The spacer 44 extends circumferentially beyond the pawl support unit 60, such that the initial wrapping, or first wrap, of the spacer 44 is without the pawl support unit. The blank 100 is initially attached to the first filter section at an end 90 of the blank, at an end of the spacer 44 extending beyond the pawl support unit. The spacer 44 is wrapped around the rod articles in one complete layer, around the whole circumference. Subsequently, the spacer 44 is wrapped together with the integrated pawl support unit in an outer layer, such that the pawl support unit and the spacer both circumscribe the whole circumference of the rod articles. The inner and outer layers of the spacer 44 are continuous and integral, and can be wrapped in one wrapping action. The pawl support unit is wrapped simultaneously with the outer of the two layers of spacer. Thus, the pawl support unit is supported in a spaced relationship from the rod articles.

The pawl support unit 60 is affixed to the interior of the sleeve 13. The sleeve 13 also extends around the spacer 44. The sleeve 13 is supported in a radial position by contact with the radially interior layer of spacer. The pawl support unit 60 is attached to the sleeve, and so can also be considered as supported by the spacer 44. The pawl support unit 60 is supported by the sleeve in a radial position spaced from the rod articles. The pawl support unit 60 is radially aligned with the outer of the layers of the spacer 44. The pawl support unit 60 is initially supported by the frangible connection with the outer of the layers of the spacer 44, and after breakage of the frangible connection 70 is supported by the sleeve 13 in the same radial position.

Figure 3:
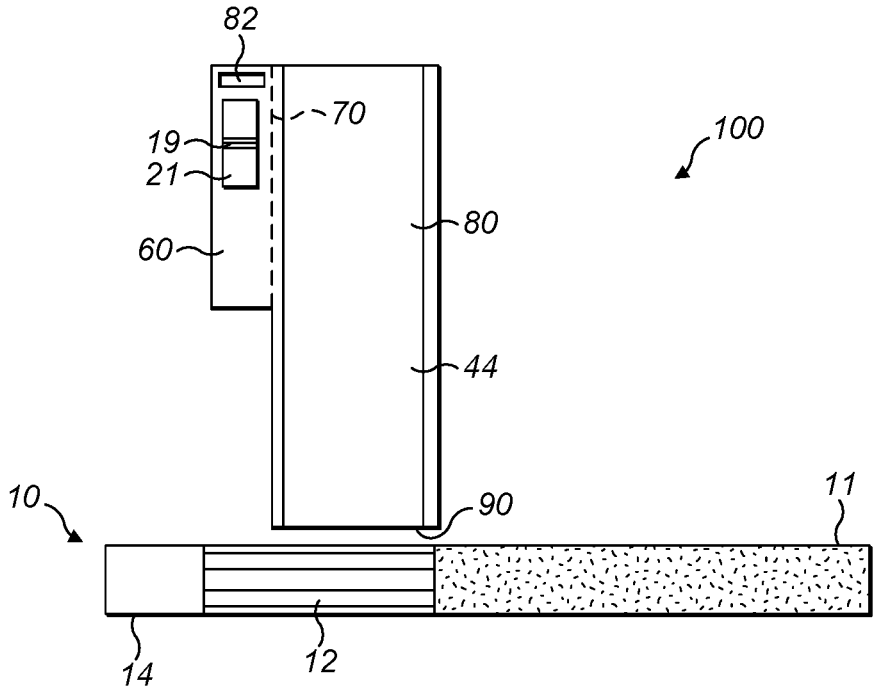
FIG. 3 is a side elevation view of components of an exemplary smoking article according to the first embodiment of the invention.

FIG. 3 shows the blank 100 as described in FIG. 2. The blank 100 is shown prior to wrapping twice around a first filter section 12. The pawl support unit 60, spacer 44, pawl 19, substrate 21 and first and second filter sections 12, 14 and tobacco rod 11 are substantially as described in FIG. 2. Generally, equivalent reference numbers indicate the same feature as described in any other embodiment. The blank 100 has a width which is substantially the same as a length of the first filter section. The pawl 19 is adjacent a longitudinal end of the first filter section. In particular, a rearward edge of the pawl 19 is adjacent a rearward edge of the first filter section.

The pawl support unit 60 is integrally formed with the spacer 44, from a single sheet of material, e.g. paper or cellulose acetate sheet. The pawl support unit 60 is arranged to frangibly disconnect from the spacer 44 along the frangible connection 70. The frangible connection 70 is formed of a line of perforations in the material of the pawl support unit and spacer. The frangible connection extends in a circumferentially extending line, allowing separation of the pawl support unit 60 from the whole length of connection with the spacer 44. The pawl support unit 60 is arranged to rotate around the rod article, spaced from the rod article by the inner layer of the wrapped spacers 44.

The blank 100 comprises one or more areas of adhesive arranged to secure the blank in its final form. A first area 80 of adhesive extends over substantially the whole area of the spacer 44. The first area 80 of adhesive secures the first layer (first wrap) spacer to the first filter section 12, and secures the second layer of spacer to the first layer. The blank 100 further comprises a second area 82 of adhesive arranged to secure the pawl support unit in a tubular form. The second area 82 of adhesive is at a circumferential end of the pawl support unit 60, which is attached last to the first filter section. The second area 82 of adhesive is arranged to overlap and adhere with the underlying wrapped pawl support unit.

Figure 4:
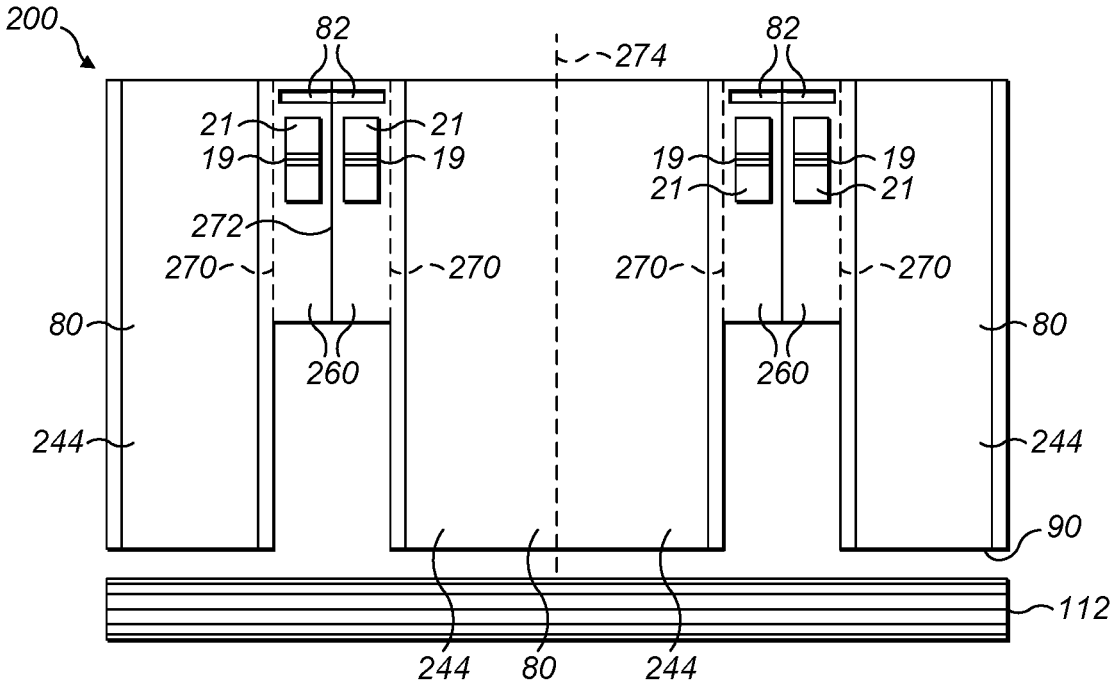
FIG. 4 is a side elevation view of components for forming an exemplary smoking article according to a second embodiment of the invention.

FIG. 4 shows a blank 200 defining spacers 244 and pawl support units 260 for forming a plurality of smoking articles. The spacers 244 and pawl support units 260, also termed support elements 260, are substantially as described with respect to FIG. 3 when wrapped around rod articles on an assembled smoking article. The blank 200 is configured to be cut into separate areas to form the spacer and pawl support units as described with respect to FIG. 3. As illustrated, the blank provides spacers and pawl support units for four smoking articles. The blank 200 comprises a pawl 19 formed on a substrate 21 for each smoking article. The pawls 19 attached to the blank 200 are separately attached for each smoking article. The blank 200 is arranged to be wrapped around one or more rod articles for a plurality of smoking articles. The rod article is a single rod article 112 dimensioned to be cut into separate filter sections, for forming a plurality of first filter sections. A first filter section formed from the rod article 112 with wrapped spacers and pawl support units can be attached to a second filter section and a tobacco rod, and wrapped by a sleeve and cover, to form a smoking article.

The blank 200 is arranged with two of the pawls 19 located adjacent to each other. In particular, the pawls are arranged in two pairs. The blank 200 is arranged to be cut along a line 274 to form spacers 244 for separate smoking articles. The blank 200 is also arranged to be cut between each of the pair of pawls 19 to form the separate smoking articles. The pawl support units 260 are separated along a line 272. The pawl support units 260 are frangibly connected to an adjacent spacer 244 by a frangible connection 270, e.g. formed by a line of perforations. The frangible connections 270 extend circumferentially when wrapped, as described with respect to FIG. 3.

The arrangement of two pawls 19 located adjacent to each other, two spacers 44 located adjacent to each other, allows a relatively simple design of blank. The blank does not alternate between an area for a pawl support unit and an area for forming a spacer. The blank has adjacent areas for forming two pawl support units 260 and an adjacent area for forming two spacers 244.

Figure 5:
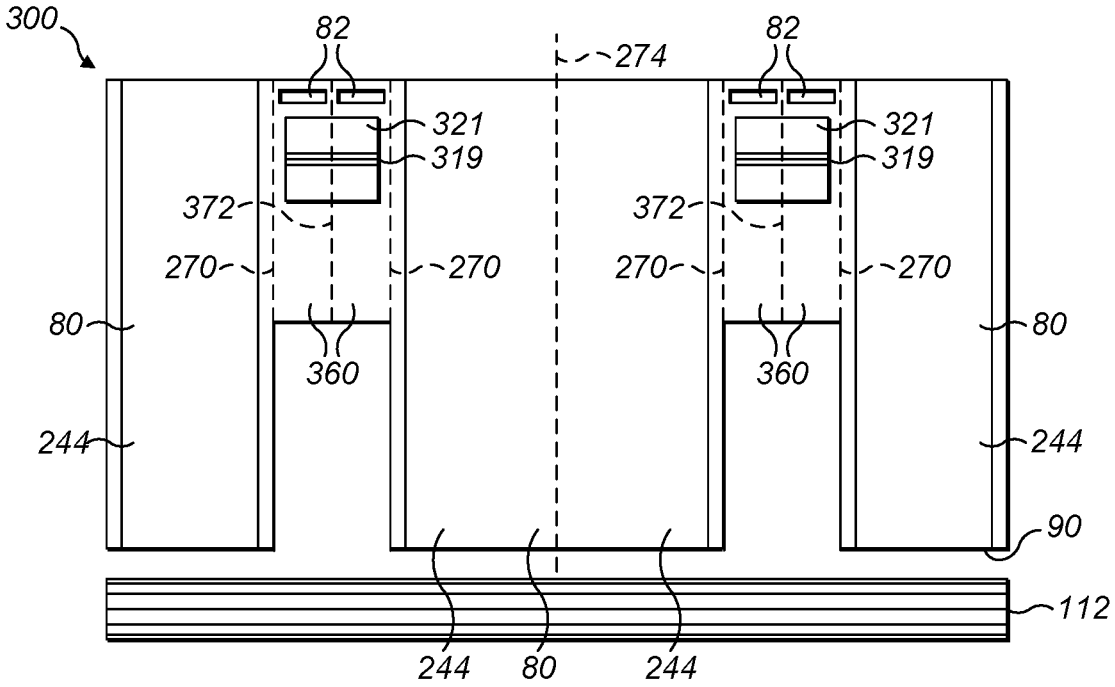
FIG. 5 is a side elevation view of components for forming an exemplary smoking article according to a third embodiment of the invention.

FIG. 5 shows an alternative embodiment of a blank 300. The overall arrangement of the blank 300 is the same as the blank 200 and the same reference numerals indicate equivalent features. The blank 300 has a different initial configuration of the pawls and substrate, although the function and final arrangement is the same or similar. One or more pawls 319 formed on a substrate 321 are attached to a pawl support unit 360 or support element 360. The substrate 321 with a pawl 319 is intended to be cut into separate pawls, one pawl each for each smoking article. The cut and separated pawls and pawl support unit are substantially the same as described above. The pawls 319 and substrate 321 are double the width of the pawls shown in FIG. 3, so that the pawl 319, substrate 321 and pawl support unit 360 can be cut together in half along a line 372. This embodiment provides for forming and attaching half the number of pawls 319, which can allow for a reduction in complexity in manufacture. The cut pawl will be located at a longitudinal edge of the pawl support unit. The pawl support unit 321 will be applied with a frangibly attached spacer on only one side, similarly to FIGS. 1 to 4.

Figure 6:
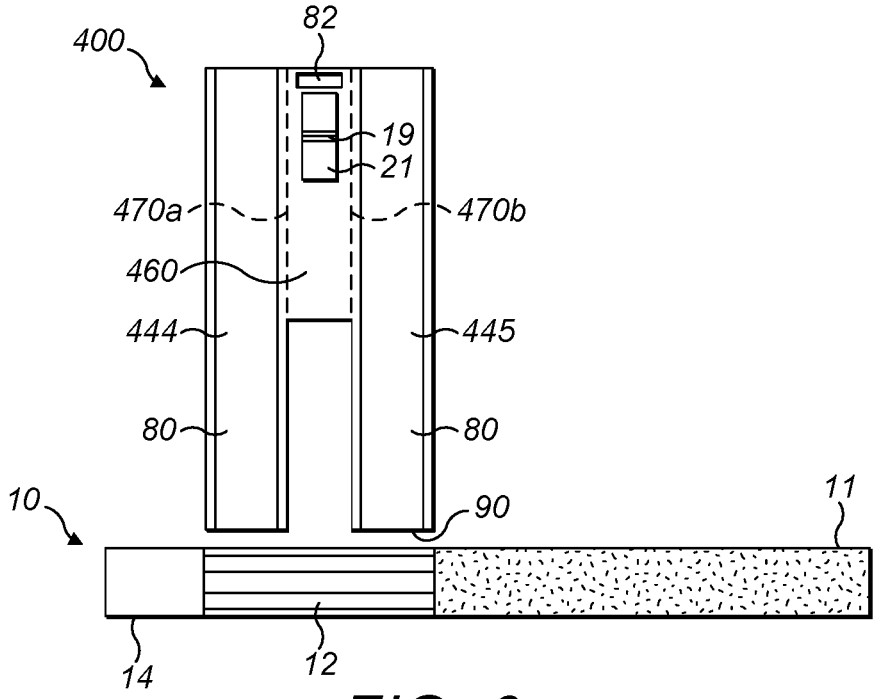
FIG. 6 is a side elevation view of components for forming an exemplary smoking article according to a fourth embodiment of the invention.

FIG. 6 shows a further embodiment of a blank 400 for forming a smoking article, with rod articles 11, 12, 14 as previously described. The blank 400 comprises a pawl support unit 460 or support element 460 and frangibly connected spacers 444, 445 on both longitudinal sides of the pawl support unit. A pawl 19 is formed on a substrate 21, and affixed to a pawl support unit 460, substantially as described above with respect to FIG. 3. The spacers 444, 445 are arranged with the spacer 444 longitudinally rearwardly of the pawl support unit, and spacer 445 longitudinally forwardly of the pawl support unit, substantially as described above with respect to the single spacer. The pawl support unit 460 is arranged to frangibly disconnect from the spacer 444 along a line 470*a* and frangibly disconnect from the spacer 445 along a line 470*b*. The lines 470*a*, 470*b* are formed of a line of perforations. The pawl support unit 460 is arranged to rotate around the rod article, spaced from the rod article by the inner layer of the wrapped spacers 444, 445. The configuration of the spacers and frangible connections is similar to FIGS. 1 to 5, with the difference that initially integral spacers extend on both longitudinal sides of the pawl support unit 460.

The blank 400 has a pawl 19 which is longitudinally spaced from an end of the first filter section. If the first filter section contains carbon (e.g. charcoal), there is a reduced risk of the charcoal fouling the pawl mechanism.

Figure 7:
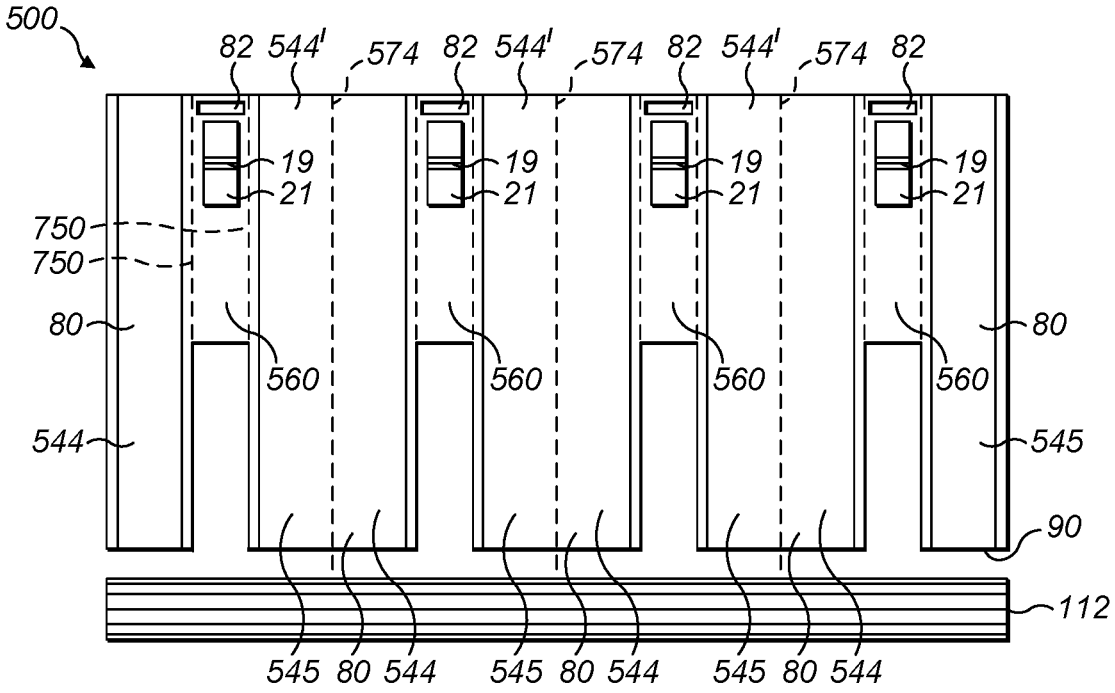
FIG. 7 is a side elevation view of components for forming an exemplary smoking article according to a fifth embodiment of the invention.

FIG. 7 shows a blank 500 for defining spacers and pawl support units for forming a plurality of smoking articles. As illustrated, the blank provides spacers and pawl support units for four smoking articles. The blank comprises a pawl 19 formed on a substrate 21 for each smoking article. The substrates 21 are each attached to a separate pawl support unit 560 or support element. The blank 500 is arranged to be wrapped around one or more rod articles for a plurality of smoking articles. The rod article is a single rod article 112 dimensioned to be cut into separate filter sections, for forming a plurality of first filter sections, as described above. A first filter section with wrapped spacers and pawl support units can be attached to a second filter section and a tobacco rod, and wrapped by a sleeve and cover, to form a smoking article, as described above.

The pawl support units 560 are each attached to a single pawl 19. The pawl support units are separated by areas 544' for forming spacers 544, 545. The areas 544' are intended to be cut to form two spacers 544, 545, each frangibly attached to the adjacent pawl support unit, as shown in FIG. 6. The spacers 544, 545 are each attached to a pawl support unit 560 by frangible connections 570. The frangible connections 570 extend circumferentially when wrapped. The frangible connections 570 provide an initial connection, which is broken by application of a force between the first and second parts of the smoking article.

Each pawl support unit 560 is spaced by an area of blank 544' which is arranged to be cut along lines 574 to form a first spacer 544 and a second spacer 545 for each separate smoking article. The blank 500 does not need to be cut around the pawls 19.

The arrangement potentially allows a more robust profile to cut down the filter from a 4 up (for forming four smoking articles) to a 1 up (for forming one smoking article).

The smoking article optionally comprise a limiter (limiting mechanism) configured to limit rotation between the first and second parts. The limiting mechanism (not shown) is configured to limit rotation to a pre-determined range. In some embodiments, the pre-determined range of rotation is through an angle of from about 90 to 180 degrees, and is, for example, about 120 degrees. The limiting mechanism limits rotation between a position in which the first and second ventilation areas have no overlap, and a further position in which the first and second ventilation areas are in full overlap. The limiting mechanism comprises engaging parts on the sleeve 13 and cover 25, which are part of the second and first parts of the smoking article respectively. Thus, the limiting mechanism is configured to limit movement between the first and second parts to a predetermined range, which is by limiting movement between the cover and second part. The limiting mechanism may optionally be formed on any of the blanks of the embodiments shown in FIGS. 3 to 7.

The first and/or second filter section comprises an adsorbent additive. In some examples, the adsorbent additive is carbon, for example, charcoal and in particular, activated carbon. Alternatively, the adsorbent additive is a resin. The resin is an ion exchange resin with a polyamine group as chelating ligand bonded onto a cross-linked polystyrene matrix, for example, Diaion® CR20. In some embodiments, the adsorbent additive is distributed within the filtration material of the first filter section 12. The adsorbent additive is substantially uniformly distributed in the filtration material. The adsorbent additive is granules of carbon.

Figure 8:
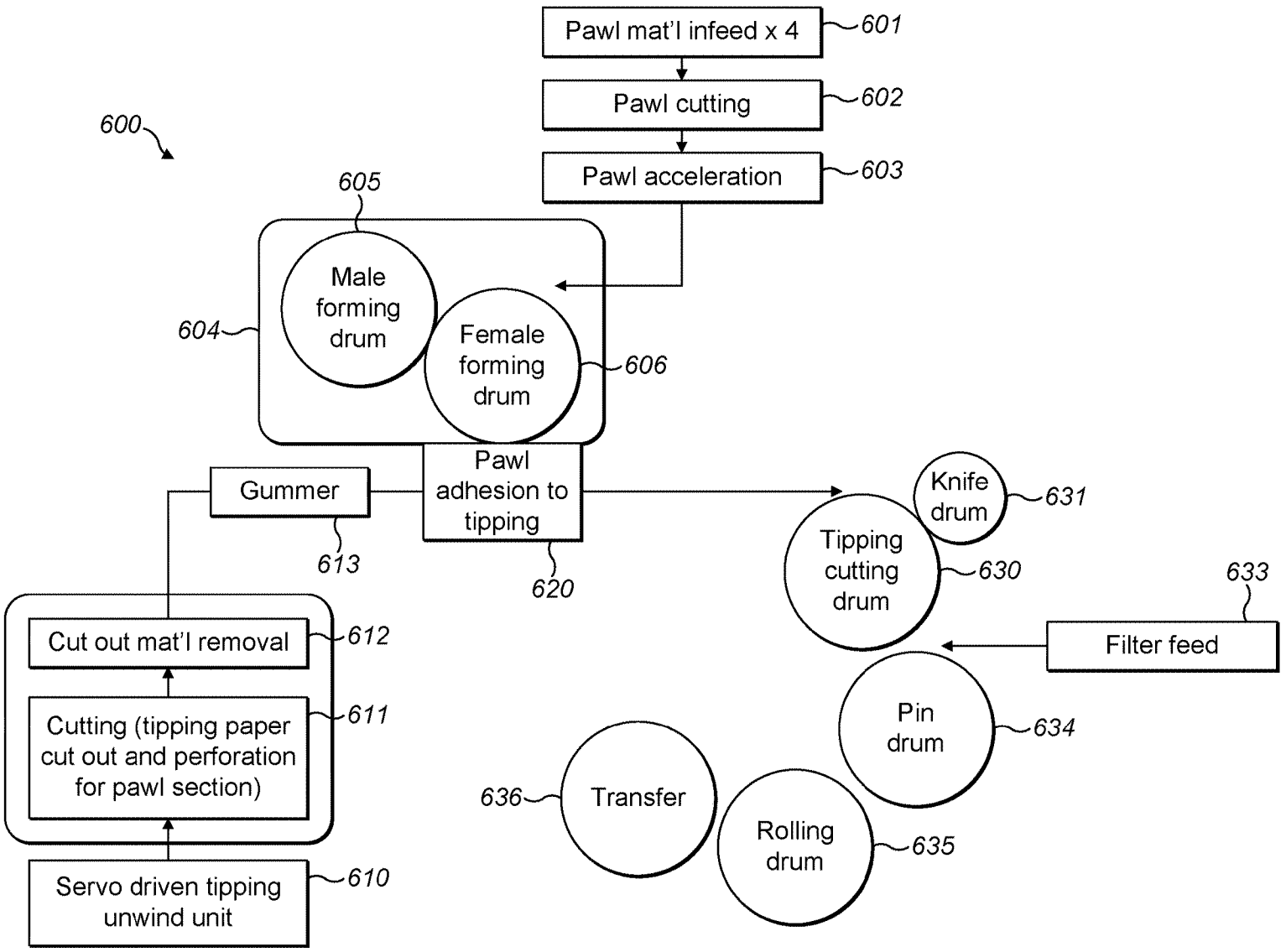
FIG. 8 is a schematic illustration of a method of manufacturing a smoking article according to an embodiment of the invention.

FIG. 8 shows an exemplary method of manufacturing the smoking article, and apparatus for manufacturing the smoking article, according to any embodiment. A material for forming the pawl and substrate is fed into an apparatus for forming the smoking article (601). The material is cut to form a pawl according to any embodiment (602). The pawl is accelerated (603) into a unit (604) for forming the second indexing surface (pawl) on the substrate. The pawl forming unit 604 comprises a male forming drum 605 and with a female forming drum 606. The male forming drum 605 and female forming drum 606 engage to form a triangular profile upstanding pawl, optionally on a substrate.

In a separate process, material for forming the pawl support unit and spacer(s) is fed from a source (610). For example, the material is fed from a servo driven unwind unit. The material is paper, for example, tipping paper. The material is cut (611) to form blanks as described above. A cut-out is formed in the material to define the spacer(s) extending from the pawl support unit. The cut-out defines the L-shape of the integral pawl support unit and single spacer. Alternatively, the cut-out defines the n-shape of the integral pawl support unit and two spacers.

In some examples, the material comprises a plurality of blanks connected together. The material is also perforated, to allow frangible separation of the spacer(s) from the pawl support unit, and/or frangible separation of pawl support units and/or frangible separation of spacers.

The cut-out material is removed (612). An adhesive is applied to the blank material, in particular over an area to affix to the substrate with pawl (613). The substrate with formed pawl from the unit 604 is affixed to the material of the pawl support unit with the adhesive (620).

If necessary, the material for forming the blank is fed to a cutting drum 630, and cut with a knife drum 631 into individual blanks for forming one or smoking articles of any embodiment. One or more rod articles, e.g. a filter, is fed from a feed 633 onto a pin drum 634, and the blank is affixed to the rod article on the pin drum. The blank is initially attached along a longitudinally extending line. The blank is attached with the pawl support unit attached to the spacer(s). The filter is a single filter section or a rod for cutting into a plurality of filter sections. The filter with attached blank is transferred to a rolling drum 635, on which the blank is wrapped twice around the rod articles, and secured as a cylinder having two layers for the spacers, one layer for the pawl support unit.

The wrapped rod article is transferred to a drum 636, for inspection. In a further process, a rod article for forming a plurality of smoking articles is cut into individual filter sections, necessary. The individual wrapped filter sections are optionally attached to one or more further filter sections, and to a tobacco rod to form a smoking article. At least one of the cover 25, sleeve 13, or a separate layer of sheet material is wrapped around, and adhered to, directly or indirectly, one or more of the first filter section 12, second filter section and tobacco rod, to connect the first filter section 12 and tobacco rod.

In use, the forward and rearward parts of the sleeve 13 and the forward and rearward parts of the cover 25 are initially connected. The smoking article optionally have a defined initial ventilation, set by the further ventilation area, and a pre-determined initial alignment of the first and second ventilation areas 30, 32. The sleeve is not readily rotatable (or slidable) relative to the tobacco unit. In addition, the pawl support unit is initially connected to a part of one or more spacers.

Application of a rotational force to the rearward part 25*b* of the cover, relative to the tobacco unit (or forward part 25*a* of the cover), breaks the cover 25 along the separation line 38 and the sleeve 13 along the separation line 36. On application of a force, the pawl support unit is broken apart from the spacer. The second part is then rotatable to vary the ventilation by alignment of the first and second ventilation areas. For example, the second part is held by the rearward part 25*b* of the cover 25, and rotated relative to the forward part 25*a* of the cover. The rotation of the second part relative to the first part causes relative movement of the second indexing surface over the first indexing surface, providing indexed rotation. All of the embodiments described relate to components for a smoking article which operates in this manner, and which has the same overall basic structure.

The invention is defined as a filter assembly, comprising the components of the smoking article without the tobacco rod 11. In particular, the assembly comprises one or more of the first and second filter sections, pawl support unit, spacer, sleeve and/or cover as described above.

The cover 25 has been described as having a rearward part 25*b* forming a component of the second part of the smoking article. Alternatively, in some embodiments, the cover 25 does not have a rearward part, and only comprises the forward part 25*a*. Rotation is obtained by rotating a rearward end of the sleeve 13 (rearwardly of the cover 25) relative to the cover 25. The second interface 40 is defined between an edge of the cover 25 and the underlying sleeve 13. The sleeve 13 does not comprise a forward part, and only comprise rearward part 13*a*.

The indexing mechanism has been described as acting between the tobacco unit and the sleeve. Alternatively, an indexing mechanism acts between the sleeve and the cover, with the cover attached to the first part of the smoking article.

The smoking article has been described as having a first filter section and a second filter section. One or both of the first filter section and a second filter section comprises a single segment of filtration material, or comprises two or more segments of filtration material joined together. Each segment comprises filtration material wrapped in a separate paper wrap. The sections or segments of filtration material have different properties, for example, the presence or absence of adsorbent additive.

The frangible connection has been described as extending circumferentially, such that the spacer(s) is wrapped twice around the rod articles. Alternatively, the line providing a frangible connection extends longitudinally at a location to provide a spacer(s) which wraps once around the rod articles. The pawl support unit extends radially around the spacer(s) to support the substrate and pawl, and control a radial position between the first and second indexing surface. The frangible connection between the spacer(s) and pawl support unit can be considered as a feature independent of the other features described.

The pawl or second indexing surface has been described as formed on a substrate, and the substrate attached to the pawl support unit. Alternatively, the pawl or second indexing surface is directly defined by the pawl support unit. For example, the material of the pawl support unit is cut or deformed to provide an upstanding pawl or other protruding feature to form the second indexing surface. In a further example, the substrate 21 defining the second indexing surface can be attached directly to the sleeve, without a tubular pawl support unit. The substrate 21 defining the second indexing surface or sleeve 13 can be considered as the support element. In a further aspect, the pawl or second indexing surface is directly defined by the sleeve 13. The sleeve 13 can be considered as the support element. These examples may not comprise an initial frangible attachment of the pawl support unit to the spacer.

In some examples of the invention, the second indexing surface (pawl) is attached to only one spacing element. This feature can be considered as a feature independent of the other features described. In particular, a smoking article can comprise a single spacer only as described, without an initial frangible attachment of the pawl support unit to the spacer.

The feature of the one or more spacer(s) extending two times around the whole circumference of the smoking article, and the pawl support unit radially aligned with the outer of the two layers of spacer, can be considered as a feature independent of the other features described. The sleeve surrounding both the spacer(s) and pawl support unit maintains the radial position of the second indexing surface relative to the first indexing surface. In particular, a smoking article can comprise a spacer comprising an inner layer and an outer layer, and a tube (sleeve) extending around the outer layer of the spacer and supporting the second indexing surface. This arrangement can be without an initial frangible attachment of the pawl support unit to the spacer. In a method of manufacture, the spacer(s) and pawl support unit are instead wrapped independently (consecutively or simultaneously) around the rod articles. This arrangement does not require a frangible connection of the pawl support unit to the spacer(s) to be broken prior to rotation between the first and second parts of the smoking article by applying a force. Once the frangible connection is broken, this arrangement functions in the same manner as a smoking article having the initial frangible connection.

Embodiments of the invention(s) have been described in this disclosure as features of a smoking article. Alternatively, the features described are provided on a filter assembly for a smoking article or a component of a smoking article.

Embodiments of the invention show locations for adhesive for connecting two components. The adhesive is applied to one of the components as shown, or alternatively or additionally is applied to the other of the components. The locations of the adhesive are merely exemplary, and different configurations of attachment, achieving the same or similar functions, can also be used.

Any of the features of any embodiment can be combined with any of the features of any other embodiment. Any of the features can provide basis for defining a separate invention, independent of any other feature.

Embodiments of the invention are configured to comply with applicable laws and/or regulations, such as, by way of non-limiting example, regulations relating to yields, constituents, testing, and/or the like. For example, an embodiment of the invention is configured such that a smoking article implementing the invention is compliant with applicable regulations before and after adjustment by a user. Such implementations are configured to be compliant with applicable regulations in all user-selectable positions. In some embodiments, the configuration is such that a smoking article implementing the invention meets or exceeds required regulatory test(s) in all user-selectable positions, such as, by way of non-limiting example, the testing threshold(s)/ceiling(s) for cigarette yields and/or smoke constituents.

Many other modifications and variations will be evident to those skilled in the art, that fall within the scope of the following claims.

In order to address various issues and advance the art, the entirety of this disclosure shows by way of illustration various embodiments in which the claimed invention(s) may be practiced and provide for superior manufacture of a smoking article. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A blank for wrapping around a rod article for one or more smoking articles, the blank comprising:

a second indexing surface on a support element, wherein the second indexing surface is configured to engage with a first indexing surface on the rod article to control relative movement between the first and second indexing surfaces, and further comprising:

one or more spacer elements arranged to radially space the support element from the first indexing surface, wherein the support element and one or more spacer elements are frangibly connected.

2. The blank as claimed in claim 1, wherein the blank is configured for a plurality of smoking articles, wherein the blank is configured to form a second indexing surface for each smoking article and comprises one or more spacer elements for each second indexing surface.

3. The blank as claimed in claim 2, wherein a first and a second of the second indexing surfaces are adjacent on the blank.

4. The blank as claimed in claim 2, wherein the second indexing surface is configured to be cut into two parts to form a separate indexing surface for each of a first and a second smoking article.

5. The blank as claimed in claim 2, wherein a first and a second of the spacer elements are adjacent on the blank.

6. The blank as claimed in claim 2, wherein second indexing surfaces and spacer elements alternate on the blank.

7. The blank as claimed in claim 1, wherein the one or more spacer elements and the support element are connected by a circumferentially extending frangible connection.

8. The blank as claimed in claim 1, wherein the spacer element comprise a first layer and a second layer configured to be wrapped around one or more rod articles of the one or more smoking articles, wherein the support element is frangibly connected to the second layer of the spacer element.

9. The blank as claimed in claim 1, wherein the support element and a single spacer element are frangibly connected.

10. The blank as claimed in claim 1, wherein the second indexing surface is located adjacent a longitudinal edge of the connected support element and one or more spacer elements.

11. The blank as claimed in claim 1, wherein the support element is frangibly connected to a first spacer element and frangibly connected to a second spacer element of the one or more spacer elements.

12. The blank as claimed in claim 1, wherein the support element and the one or more spacer elements are frangibly connected by means of a frangible connection wherein the frangible connection is arranged such that the support element disconnects from the one or more spacer elements when the first part is moved relative to the second part.

* * * * *